US006699536B2

(12) United States Patent
Katoh et al.

(10) Patent No.: US 6,699,536 B2
(45) Date of Patent: Mar. 2, 2004

(54) INK JET RECORDING SHEET

(75) Inventors: Eisaku Katoh, Hino (JP); Yoshinori Tsubaki, Hino (JP)

(73) Assignee: Konica Corporation (JP)

( * ) Notice: Subject to any disclaimer, the term of this patent is extended or adjusted under 35 U.S.C. 154(b) by 2 days.

(21) Appl. No.: 10/008,916

(22) Filed: Dec. 3, 2001

(65) Prior Publication Data

US 2002/0115773 A1 Aug. 22, 2002

(30) Foreign Application Priority Data

Dec. 7, 2000 (JP) ..... 2000-372740

(51) Int. Cl.[7] ..... B41M 5/00

(52) U.S. Cl. ..... 428/32.28; 428/32.29; 428/32.34

(58) Field of Search ..... 428/195, 323, 428/328, 483, 500, 514, 522, 32.28, 32.29, 32.34

(56) References Cited

U.S. PATENT DOCUMENTS 4,554,181 A * 11/1985 Cousin et al. ..... 427/261
4,830,911 A * 5/1989 Kojima et al. ..... 428/342
5,126,010 A * 6/1992 Kobayashi et al. ..... 162/135
5,165,973 A * 11/1992 Kojima et al. ..... 428/331
6,054,223 A * 4/2000 Tsuchiya et al. ..... 428/478.2
6,214,458 B1 * 4/2001 Kobayashi et al. ..... 428/332
6,432,550 B1 * 8/2002 Ohbayashi et al. ..... 428/511
6,521,323 B1 * 2/2003 Sakaki et al. ..... 428/195
6,576,326 B2 * 6/2003 Hatano et al. ..... 428/195

FOREIGN PATENT DOCUMENTS

EP 1 034 940 A1 * 9/2000

* cited by examiner

*Primary Examiner*—Cynthia H. Kelly
*Assistant Examiner*—B. Shewareged
(74) *Attorney, Agent, or Firm*—Muserlian, Lucas and Mercanti

(57) ABSTRACT

An ink jet recording sheet comprising a support having thereon a porous ink absorptive layer comprising inorganic particles, polyvinyl alcohol, at least two cationic polymers having a quarternary ammonium salt group in the molecule, and a compound containing a zirconium atom or an aluminum atom other than zirconium oxide and aluminum oxide.

3 Claims, No Drawings

INK JET RECORDING SHEET

FIELD OF THE INVENTION

The present invention relates to an ink jet recording sheet, and particularly to an ink jet recording sheet which exhibits excellent ink absorbability, minimizes bleeding, and results in high color density.

BACKGROUND OF THE INVENTION

In recent years, ink jet recording has increasingly resulted in enhancement of image quality which is approaching that of conventional photography. In order to achieve such conventional photographic quality, improvement has been made in the area of recording sheets. A void type recording sheet, which comprises a highly smoothened support having thereon a minute-void layer comprised of fine particles and hydrophilic polymers, exhibits high gloss, results in bright color formation, and exhibits excellent ink absorbability as well as ink drying properties. Accordingly, said recording sheet has been regarded as one of those which are most similar to conventional photographic quality. Specifically, when a non-water absorptive support is employed, it is possible to prepare high quality prints because cockling (wrinkling), which is noticed in a water absorptive support, is not present, and it is possible to maintain the highly smoothened surface.

Ink jet recording is mainly divided into two types; one in which ink, comprised of water-soluble dyes, is employed and the other in which ink, comprised of pigments, is employed. The ink comprised of pigments results in highly durable images but gloss tends to vary imagewise. As a result, it is difficult to prepare prints which exhibit conventional photographic quality. On the other hand, when an ink, comprised of water-soluble dyes, is employed, it is possible to obtain very bright and clear images of uniform gloss. Accordingly, it is possible to prepare color prints approaching conventional photographic quality.

However, ink, comprised of water-soluble dyes, results in disadvantages such as bleeding and poor water resistance due to the high hydrophilicity of said water-soluble dyes. Namely, when after printing, prints are stored at high humidity for a long period of time, or water droplets are allowed to adhere onto the print surface, said dyes tends to result in bleeding.

In order to overcome such drawbacks, it is a general practice to incorporate dye fixing materials such as cationic materials into a porous layer.

A method preferably employed is one in which, for example, an anionic dye is allowed to bond to a cationic polymer so as to be immobilized. Cited as such cationic polymers are polymers of quaternary ammonium salts, which are, for example, described in the conventional art of "Ink Jet Printer Gijutsu to Zairyo (Technology and Materials of Ink Jet Printers)", (published by CMC Co., Ltd., July 1998) and Japanese Patent Publication Open to Public Inspection No. 9-193532.

Further, a method has been proposed in which water-soluble polyvalent metal ions are previously incorporated into an ink jet recording sheet so that during ink jet recording, dyes are immobilized while being coagulated and fixed.

However, when such cationic polymers and water-soluble polyvalent ions are incorporated to minimize bleeding as well as to enhance water resistance, said dyes tend to coagulate on the surface. As a result, the image surface tends to result in a bronzing phenomena, in which the image surface exhibits a metallic gloss. Said bronzing tends to generally occur when prints are stored in a highly humid environment.

The inventors of the present invention conducted investigations of said drawbacks and discovered that when specific cationic polymers and specific compounds having a zirconium or aluminum atom were incorporated, it was possible to minimize bleeding, as well as to enhance water resistance without bronzing.

It has been known that compounds containing a zirconium atom and an aluminum atom are employed in ink jet recording sheets.

Japanese Patent Publication Open to Public Inspection Nos. 55-53591, 55-150396, 56-867789, 58-89391, and 58-94491 describe ink jet recording sheets comprised of water-soluble polyvalent metal salts which bond to water-soluble dyes to form minimally water-soluble salts.

Further, Japanese Patent Publication Open to Public Inspection Nos. 60-67190, 61-10484, and 61-57379 describe ink jet recording sheets comprised of cationic polymers as well as water-soluble polyvalent metal salts.

Japanese Patent Publication Open to Public Inspection No. 60-257286 describes an ink jet recording sheet comprised of basic polyhydroxyl aluminum compounds.

Further, Japanese Patent Publication Open to Public Inspection No. 10-258567 discloses a method employing a hydrophilic polymer and a water-soluble compound comprising a 4A group element, in combination, while Japanese Patent Publication Open to Public Inspection No. 10-309862 discloses a method employing a hydrophilic polymer together with a polyhydric carboxylic acid, and a zirconyl compound, also in combination.

Further, regarding compounds comprising said zirconium element, Japanese Patent Publication Open to Public Inspection No. 4-7189 discloses a method employing a porous pigment and an acid zirconium chloride compound. Said patent specification describes that by adding said acid zirconium chloride salt, desired adhesion strength is obtained employing a relatively small amount of binder, and it is possible to achieve improvement of image quality.

Japanese Patent Publication Open to Public Inspection No. 6-32046 discloses a method in which a zirconium compound is combined with silica and modified polyvinyl alcohol Further, European Patent No. 754,560 discloses that a water-soluble binder, a pigment, a zirconium compound, and a cationic polymer are employed in combination.

However, the prior art, as above, does not describe effects to minimize bronzing of prints. It was verified that in some cases, more bronzing resulted.

SUMMARY OF THE INVENTION

An object of the present invention is to provide an ink jet recording sheet in which, after printing, the water-soluble dye results in minimized bleeding during storage and improvement in water resistance.

Another object of the present invention is to provide an ink jet recording sheet in which the ink absorption rate is improved without enhancing bleeding.

Said objects as above were achieved employing the constitution described below.

1. An ink jet recording sheet comprising a support having thereon a porous ink absorptive layer comprising inorganic particles, polyvinyl alcohol, at least two cationic polymers having a quaternary ammonium salt group in the molecule, and a compound containing a zirconium atom or an aluminum atom other than zirconium oxide and aluminum oxide.
2. The ink jet recording sheet of item 1, wherein said cationic polymers are represented by Formula (1) or by Formula (2), Formula (1):

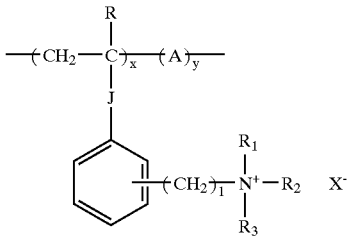

wherein R represents a hydrogen atom or an alkyl group; $R_1$, $R_2$, and $R_3$ each represent an alkyl group or a benzyl group; J represents a bond or a divalent organic group; $X^-$ represents an anion group; A represents a repeating unit having no quaternary ammonium salt group; l represents an integer of 1 to 6; x represents 5 to 100 mol %; and y represents 0 to 95 mol %, Formula (2):

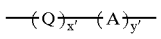

wherein Q represents a repeating unit represented by Formula (2A), (2B), or (2C); A represents a repeating unit having no quaternary ammonium salt group, x' represents 5 to 100 mol % and y' represents 0 to 95 mol %, Formula (2A):

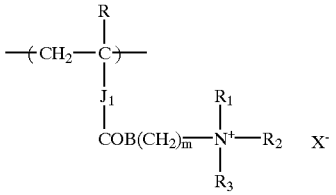

wherein R, $R_1$, $R_2$, and $R_3$, and $X^-$ are the same as defined for R, $R_1$, $R_2$, and $R_3$, and $X^-$ of Formula (1); $J_1$ represents a bond or a divalent organic group; B represents —O— or —N($R_5$)—, wherein $R_5$ represents a hydrogen atom, an alkyl group, an allyl group, or a benzyl group; and m represents an integer of 1 to 6, Formula (2B):

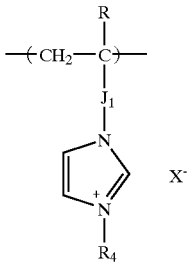

wherein R and $X^-$ are the same as defined for R and $X^-$ of Formula (1); $J_1$ is the same as defined above for $J_1$ of Formula (2A); and $R_4$ represents an alkyl group, Formula (2C):

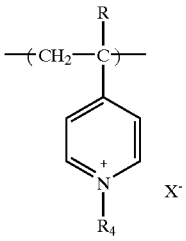

wherein R and $X^-$ are the same as defined for R and $X^-$ of Formula (1), and $R_4$ is the same as defined for $R_4$ of Formula (2B).

3. An ink jet recording sheet comprising a support having thereon a porous ink absorptive layer comprising inorganic particles, polyvinyl alcohol, a cationic polymer having at least two repeating units comprising a quaternary ammonium salt group or a tertiary amino group, and a compound containing a zirconium atom or an aluminum atom other than zirconium oxide and aluminum oxide.

4. The ink jet recording sheet of item 3, wherein said repeating units are represented by Formula (1A), (2A), (2B), (2C), (3A), (3B), (3C) or (3D), Formula (1A):

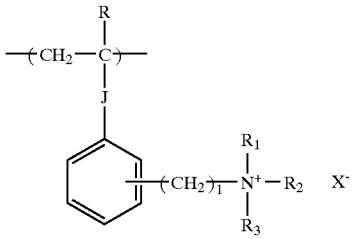

wherein R represents a hydrogen atom or an alkyl group; $R_1$, $R_2$, and $R_3$ each represent an alkyl group or a benzyl group; J represents a bond or a divalent organic group; $X^-$ represents an anion group, l represents an integer of 1 to 6, Formula (2A):

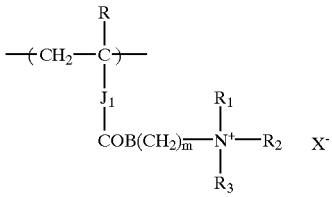

wherein R, $R_1$, $R_2$, and $R_3$, and $X^-$ are the same as defined for R, $R_1$, $R_2$, and $R_3$, and $X^-$ of Formula (1A); $J_1$ represents a bond or a divalent organic group; B represents —O— or —N($R_5$)—, wherein $R_5$ represents a hydrogen atom, an alkyl group, an allyl group, or a benzyl group; and m represents an integer of 1 to 6, Formula (2B):

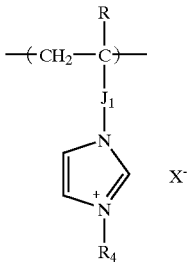

wherein R and $X^-$ are the same as defined for R and $X^-$ of Formula (1A); $J_1$ is the same as defined above for $J_1$ of Formula (2A); and $R_4$ represents an alkyl group, Formula (2C):

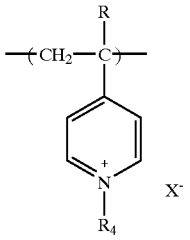

wherein R and $X^-$ are the same as defined for R and $X^-$ of Formula (1A), and $R_4$ is the same as defined for $R_4$ of Formula (2B), Formula (3A):

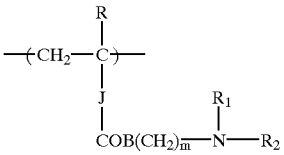

wherein R represents a hydrogen atom or an alkyl group; $R_1$ and $R_2$ each represent a hydrogen atom or an alkyl group; J represents a bond or a divalent organic group; B represents —O— or —N($R_5$)—, wherein $R_5$ represents a hydrogen atom, an alkyl group, an allyl group, or a benzyl group; and m represents an integer of 1 to 6, Formula (3B):

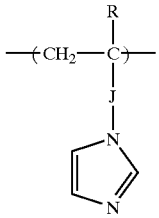

wherein R represents a hydrogen atom or an alkyl group; J represents a bond or a divalent organic group, Formula (3C):

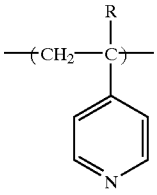

wherein R represents a hydrogen atom or an alkyl group,

Formula (3D):

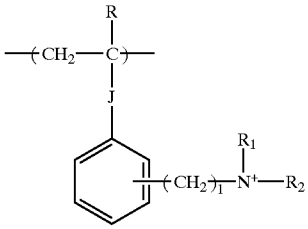

wherein R represents a hydrogen atom or an alkyl group; $R_1$ and $R_2$ each represent a hydrogen atom, an alkyl group, or a benzyl group; J represents a bond or a divalent organic group; l represents an integer of 0 to 6.

5. An ink jet recording sheet comprising a support having thereon a porous ink absorptive layer comprising inorganic particles, polyvinyl alcohol, a cationic polymer having a quaternary ammonium salt group, a cationic polymer having a tertiary amino group, and a compound containing a zirconium atom or an aluminum atom other than zirconium oxide and aluminum oxide.

6. The ink jet recording sheet of item 5, wherein said cationic polymer having a quaternary ammonium salt group is represented by Formula (1) or Formula (2) and said cationic polymer having a tertiary amino group is represented by Formula (3), Formula (1):

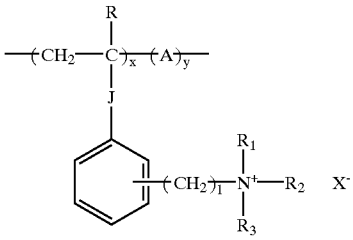

wherein R represents a hydrogen atom or an alkyl group; $R_1$, $R_2$, and $R_3$ each represent an alkyl group or a benzyl group; J represents a bond or a divalent organic group; $X^-$ represents an anion group; A represents a repeating unit having no quaternary ammonium salt group in the molecule; l represents an integer of 1 to 6; x represents 5 to 100 mol %; and y represents 0 to 95 mol %, Formula (2):

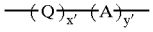

wherein Q represents a repeating unit represented by Formula (2A), (2B), or (2C); A represents a repeating unit having no quaternary ammonium salt group, x' represents 5 to 100 mol % and y' represents 0 to 95 mol %, Formula (2A):

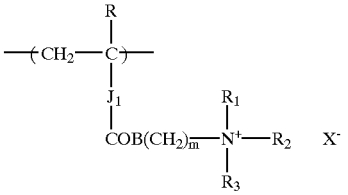

wherein R, $R_1$, $R_2$, and $R_3$, and $X^-$ are the same as defined for R, $R_1$, $R_2$, and $R_3$, and $X^-$ of Formula (1); $J_1$ represents a bond or a divalent organic group; B represents —O— or —N($R_5$)—, wherein $R_5$ represents a hydrogen atom, an alkyl group, an allyl group, or a benzyl group; and m represents an integer of 1 to 6, Formula (2B):

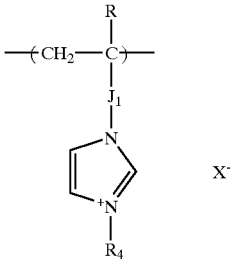

wherein R and $X^-$ are the same as defined for R and $X^-$ of Formula (1); $J_1$ is the same as defined above for $J_1$ of Formula (2A); and $R_4$ represents an alkyl group, Formula (2C):

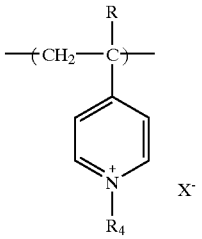

wherein R and $X^-$ are the same as defined for R and $X^-$ of Formula (1), and $R_4$ is the same as defined for $R_4$ of Formula (2B), Formula (3):

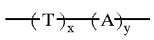

wherein T represents a repeating unit represented by Formula (3A), (3B), (3C) or (3D); A represents a repeating unit having no quaternary ammonium salt group, x represents 5 to 100 mol % and y represents 0 to 95 mol %, Formula (3A):

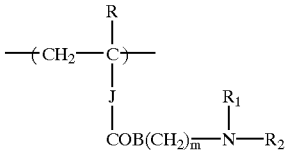

wherein R represents a hydrogen atom or an alkyl group; $R_1$ and $R_2$ each represent a hydrogen atom or an alkyl group; J represents a bond or a divalent organic group; B represents —O— or —N($R_5$)—, wherein $R_5$ represents a hydrogen atom, an alkyl group, an allyl group, or a benzyl group; and m represents an integer of 2 to 6, Formula (3B):

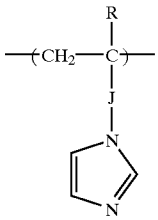

wherein R represents a hydrogen atom or an alkyl group; J represents a bond or a divalent organic group, Formula (3C):

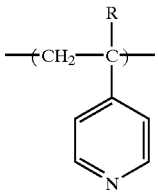

wherein R represents a hydrogen atom or an alkyl group,

Formula (3D):

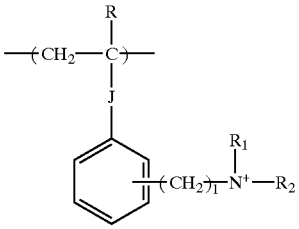

wherein R represents a hydrogen atom or an alkyl group; $R_1$ and $R_2$ each represent a hydrogen atom, an alkyl group, or a benzyl group; J represents a bond or a divalent organic group; l represents an integer of 0 to 6.

7. An ink jet recording sheet comprising a support having thereon a porous ink absorptive layer comprising inorganic particles, polyvinyl alcohol, a cationic polymer having a repeating unit comprising an amido group or a hydroxy group, and a compound containing a zirconium or aluminum atom other than zirconium oxide and aluminum oxide.

8. The ink jet recording sheet of item 7, wherein said repeating unit is represented by Formula (A-1) or Formula (A-2), Formula (A-1):

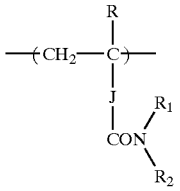

wherein R represents a hydrogen atom or an alkyl group; $R_1$ and $R_2$ each represent a hydrogen atom, an alkyl group, or a benzyl group; J represents a bond or a divalent organic group, Formula (A-2):

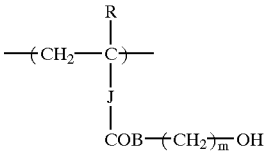

wherein R represents a hydrogen atom or an alkyl group; J represents a bond or a divalent organic group; B represents —O— or —N($R_5$)—, wherein $R_5$ represents a hydrogen atom, an alkyl group, an allyl group, or a benzyl group; m represents an integer of 2 to 6.

9. The ink jet recording sheet of item 7, wherein said cationic polymer is represented by Formula (5), Formula (5):

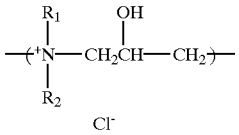

wherein $R_1$ and $R_2$ each represent a hydrogen atom or an alkyl group.

DETAILED DESCRIPTION OF THE INVENTION

The present invention will now be detailed. The compounds (however, excluding zirconium oxide and aluminum oxide) containing a zirconium atom or an aluminum atom may be either water-soluble or non-water soluble, as long as those can be uniformly incorporated into said ink absorptive layer.

Said compounds containing a zirconium atom or an aluminum atom, which are usable in the present invention, may be any of the single or double salts of inorganic or organic acids, organic metal compounds, or metal complexes.

Listed as specific examples of zirconium atom containing compounds which are usable in the present invention are zirconium difluoride, zirconium trifluoride, zirconium tetrafluoride, hexafluorozirconate (for example, potassium salts), heptafluorozirconate (for example, sodium salts, potassium salts, and ammonium salts), octafluorozirconate (for example, lithium salts), zirconium fluoride oxide, zirconium dichloride, zirconium trichloride, zirconium tetrachloride, hexachlorozirconate (for example, sodium salts and potassium salts), zirconium oxychloride (zirconyl chloride), zirconium dibromide, zirconium tribromide, zirconium tetrabromide, zirconium bromide oxide, zirconium triiodide, zirconium tetraiodide, zirconium peroxide, zirconium hydroxide, zirconium sulfide, zirconium sulfate, zirconium p-toluenesulfonate, zirconyl sulfate, sodium zirconyl sulfate, acidic zirconyl sulfate trihydrate, potassium zirconyl sulfate, zirconium selenate, zirconium nitrate, zirconyl nitrate, zirconium phosphate, zirconium carbonate, ammonium zirconyl carbonate, zirconium acetate, zirconyl acetate, ammonium zirconyl acetate, zirconyl lactate, zirconyl citrate, zirconyl stearate, zirconium phosphate, zirconyl phosphate, zirconium oxalate, zirconium isopropionate, zirconium butyrate, zirconium acetylacetonate, acetyl acetone zirconium butyrate, zirconium stearate butyrate, zirconium acetate, and bis(acetylacetonato)dichlorozirconium, and tris (acetylacetonato)chlorozirconium.

Of these compounds containing a zirconium atom, preferred are zirconyl carbonate, ammonium zirconyl carbonate, zirconyl acetate, zirconyl nitrate, zirconium oxychloride, zirconium lactate, and zirconyl citrate, and ammonium zirconyl carbonate and zirconyl acetate are most preferred.

Listed as specific examples of aluminum atom containing compounds which are usable in the present invention are aluminum fluoride, hexafluoroaluminate (for example, potassium salts), aluminum chloride, basic aluminum chloride (polyaluminum chloride), tetrachloroaluminate (for example, sodium salts), aluminum bromide, tetrabromoaluminate (for example, potassium salts), aluminum iodide, aluminate (for example, sodium salts, potassium salts, and calcium salts), aluminum chlorate, aluminum perchlorate, aluminum thiocyanate, aluminum sulfate, basic aluminum sulfate, aluminum sulfate potassium (alum), ammonium aluminum sulfate (ammonium alum), sodium sulfate aluminum, aluminum phosphate, aluminum nitrate, aluminum hydrogenphosphate, aluminum carbonate, polyaluminum sulfate silicate, aluminum formate, aluminum acetate, aluminum lactate, aluminum oxalate, aluminum isopropionate, aluminum butyrate, ethyl acetate aluminum diisopropionate, aluminum tris(acrtylacetonate), aluminum tris(ethylacetoacetate), and aluminum monoacetylacetonatebis(ethylacetoacetate).

Of these, preferred are aluminum chloride, basic aluminum chloride, aluminum sulfate, basic aluminum sulfate, and basic aluminum sulfate silicate.

Said compounds containing a zirconium atom or an aluminum atom may be incorporated into an ink absorptive layer forming coating composition. The resulting coating composition is coated and subsequently dried. Alternatively, after coating and drying a porous layer, said compounds may be incorporated into said ink absorptive layer, employing an overcoating method.

Said compounds containing a zirconium atom or an aluminum atom are dissolved in water, organic solvents, or a solvent mixture consisting of water and said organic solvents are dispersed into fine particles, employing a wet crushing method such as a sand mill or a method such as emulsifying dispersion. The resulting solution or dispersion may be added to an ink absorptive layer forming coating composition. When said ink absorptive layer is comprised of a plurality of layers, the resulting solution or dispersion may be added to only one layer, at least two layers or coating compositions forming all layers.

Further, when after forming a porous ink absorptive layer, said compounds are added employing said overcoating method, it is preferable that they are uniformly dissolved in solvents and the resulting solution is then added.

The used amount of said compounds containing a zirconium atom or an aluminum atom is generally in the range of 0.01 to 5 g per $m^2$ of the ink jet recording sheet, is preferably in the range of 0.05 to 2 g, and is most preferably in the range of 0.1 to 1 g.

Said compounds may be employed in combination of at least two types. In this case, zirconium atom containing compounds may be employed in combination of at least two types, aluminum containing compounds may be employed in combination of at least two types, or compounds containing a zirconium atom and compounds containing an aluminum atom may be employed in combination.

Fine inorganic particles employed in the ink jet recording sheet of the present invention will now be described.

Employed as said fine inorganic particles my be various types of fine solid particles conventionally known in the art of ink jet recording sheets.

Cited as examples of said fine inorganic particles may be white inorganic pigments such as precipitated calcium carbonate, heavy calcium carbonate, magnesium carbonate, kaolin, clay, talc, calcium sulfate, barium sulfate, titanium dioxide, zinc oxide, zinc hydroxide, zinc sulfide, zinc carbonate, hydrotalcite, aluminum silicate, diatomaceous earth, calcium silicate, magnesium silicate, synthetic non-crystalline silica, colloidal silica, alumina, colloidal alumina, pseudo boehmite, aluminum hydroxide, lithopone, zeolite, and magnesium hydroxide.

Said fine particles may be employed in such a state that primary particles are uniformly dispersed in binders without any modification, or in such a state that secondary coagulated particles are formed which are dispersed into the binders. However, the latter is preferred.

The shape of said fine inorganic particles is not particularly limited and may be spherical, cylindrical, acicular, tabular, or rosary-shaped.

The average diameter of the primary particles of said fine inorganic particles is preferably from 3 to 30 nm.

When fine primary particles, having a diameter of 30 nm or more, are employed, it is difficult to obtain clear and bright images due to a decrease in glossiness of the recording sheet or a decrease in maximum density due to diffused surface reflection. The lower limit of the average diameter of said primary particles is also not particularly limited, but from the viewpoint of producing said particles, the diameter is commonly at least about 3 nm, and is preferably at least 6 nm.

The average diameter of said fine particles may be obtained as follows. Said particles themselves, or the cross-section or surface of a void layer, is observed employing an electron microscope, and each diameter of many randomly selected particles is determined. The simple average (being the number average) is obtained as the diameter of said particles based on the determined diameter. Herein, each particle diameter is represented by the diameter of the circle having the same projection area as that of said particle.

When a porous ink absorptive layer is formed while forming particularly preferable secondary or higher order particles, the diameter of said particles is preferably from 20 to 100 nm.

Composite particles comprised of fine inorganic particles and a small amount of organic materials (which may be either lower molecular weight compounds or polymers) are basically designated as the fine inorganic particles according to the present invention. Even in this case, the diameter of the highest order particles observed in the dried layer is determined as that of the fine inorganic particles.

The ratio of organic materials/fine inorganic particles in said composite particles comprised of fine inorganic particles and a small amount of organic materials is generally from 1/100 to 1/4.

Preferred as the fine inorganic particles according to the present invention are those which are less expensive, have a low refractive index from the viewpoint of being capable of producing a high reflection density. Of those, silica, especially silica synthesized employing a gas phase method or colloidal silica, is more preferred.

Further, it is possible to employ cation surface-treated silica synthesized employing a gas phase method, cation surface-treated colloidal silica and alumina, colloidal alumina, and pseudo boehmite.

The added amount of fine inorganic particles, employed in the ink absorptive layer, varies largely depending on the desired ink absorption capacity, the void ratio of the void layer, the types of fine inorganic particles, and the types of hydrophilic binders, but is generally from 3 to 30 g per $m^2$ of the recording sheet, and is preferably from 5 to 25 g. The ratio of fine inorganic particles to polyvinyl alcohol, employed in said ink absorptive layer, is generally from 2:1 to 20:1, and is preferably from 3:1 to 10:1.

As the added amount of said fine inorganic particles increases, the ink absorption capacity also increases, while curling and cracking do tend to occur. Accordingly, a method, in which the ink absorption capacity is increased by controlling the void ratio, is more preferred. The void ratio is preferably from 40 to 75 percent. It is possible to adjust said void ratio utilizing the selected fine inorganic materials, the types of binders, or the mixing ratio thereof, or the amount of other additives.

The void ratio, as described herein, is the ratio of the total volume of voids to the volume of the void layer, and can be calculated utilizing the total volume of the layer constituting materials and the thickness of the layer. Further, the total volume of the voids is easily obtained through the saturated transition amount and the absorbed water amount utilizing Bristow's Measurement.

Polyvinyl alcohol incorporated into the ink jet recording sheet of the present invention will now be described.

Polyvinyl alcohol employed in the present invention include common polyvinyl alcohol prepared by hydrolyzing polyvinyl acetate, and in addition, modified polyvinyl alcohol such as terminal cation-modified polyvinyl alcohol and anion-modified polyvinyl alcohol having an anionic group.

The average degree of polymerization of polyvinyl alcohol prepared by hydrolyzing vinyl acetate is preferably 1,000 or more, and is more preferably from 1,500 to 5,000. Further, the saponification ratio is preferably from 70 to 100 percent, and is more preferably from 80 to 99.5 percent.

Said cation-modified polyvinyl alcohol includes, for example, polyvinyl alcohol having a primary, secondary or tertiary amino group, or a quaternary ammonium group in the main or side chain of said polyvinyl alcohol, as described in Japanese Patent Publication Open to Public Inspection No. 61-10483, and can be prepared by saponifying the copolymer of ethylenic unsaturated monomers having a cationic group, and vinyl acetate.

Listed as ethylenic unsaturated monomers are, for example, trimethyl-(2-acrylamido-2,2-dimethylethyl) ammonium chloride, trimethyl-(3-acrylimido-3,3-dimethylpropyl)ammonium chloride, N-vinylimidazole, N-vinyl-2-methylimidazole, N-(3-dimethylaminopropyl) methacrylamide, hydroxyethyltrimethylammonium chloride, trimethyl-(2-methacryamidopropyl)ammonium chloride, and N-(1,1-dimethyl-3-dimethylaminopropyl) ammonium chloride.

The content ratio of said monomers containing a cation-modified group of said cation-modified polyvinyl alcohol is from 0.1 to 10 mol percent with respect to the vinyl acetate, and is preferably from 0.2 to 5 mol percent.

Listed as anion-modified polyvinyl alcohol are, for example, polyvinyl alcohol containing an anionic group, described in Japanese Patent Publication Open to Public Inspection No. 1-206088, copolymers of vinyl alcohol and vinyl compounds containing a water solubilizing group, described in Japanese Patent Publication Open to Public Inspection Nos. 61-237681 and 63-307979, and modified polyvinyl alcohol containing a water solubilizing group, described in Japanese Patent Publication Open to Public Inspection No. 7-285265.

Further, listed as nonion-modified polyvinyl alcohols are, for example, polyvinyl alcohol derivatives in which a polyalkylene oxide group is added to a part of polyvinyl alcohol, described in Japanese Patent Publication Open to Public Inspection No. 7-9758, and block copolymers of vinyl compounds having a hydrophobic group and polyvinyl alcohol, described in Japanese Patent Publication Open to Public Inspection No. 8-25795.

Still further, the polyvinyl alcohol of the present invention includes silyl group-modified polyvinyl alcohol as said modified polyvinyl alcohol.

Further, various types of polyvinyl alcohols, in which the degree of polymerization, the degree of saponification, or modification is different, may be employed in a combination of at least two types.

In addition to said polyvinyl alcohols, hydrophilic polymers may be incorporated into the ink absorptive layer of the ink jet recording sheet of the present invention.

Listed as examples of said hydrophilic polymers may be, for example, gelatin, polyethylene oxide, polyvinylpyrrolidone, casein, starch, agar, carrageenan, polyacrylic acid, polymethacrylic acid, polyacryl amide, polymethacrylamide, polystyrene sulfonic acid, cellulose, carboxymethyl cellulose, hydroxyethyl cellulose, dextran, and pullulan. The added amount of these hydrophilic polymers may be preferably in the range of 0 to 50 percent by weight with polyvinyl alcohol, and may be most preferably in the range of 0 to 20 percent by weight.

The cationic polymers employed in the ink jet recording sheet of the present invention will now be described.

At least two types of cationic polymers, having a quaternary ammonium salt group, are employed in the ink jet recording sheet described in item 1 of the present invention.

The reason of decreasing bronzing by making use of at least two types of cationic polymers in the same layer is not fully clarified. But it is assumed that the coexistence of the cationic polymers having a different molecular structure with coloring materials would prevent the dyes from recrystallization.

Two types of cationic polymers, as described herein, refer to the polymers in which the composition of the repeating units differs from each other in said polymer composition, and do not include polymers in which the degree of polymerization simply differs from each other.

Further, item 1 of the present invention includes two types of cationic polymers in which the composition itself of the repeating units is the same as each other but the mole ratio constituting said polymer differs. However, it is preferable that at least two types of cationic polymers, in which the structure of repeating units themselves differs, are employed. Preferred two cationic polymers of item 1 are combination of a polymer represented by Formula (1) and Formula (2). Of Formula (2), Formula (2A) is more preferred.

Listed as examples of cationic polymers having a quaternary ammonium salt group employed in item 1 of the present invention may be cationic polymers having a guanydyl group described in Japanese Patent Publication Open to Public Inspection No. 57-64591, dimethyldiallylammonium chloride described in Japanese Patent Publication Open to Public Inspection No. 59-20696, polyaminesulfones described in Japanese Patent Publication Open to Public Inspection No. 59-33176, acrylic acid alkyl quaternary ammonium salts or methacrylic acid alkyl quaternary ammonium salts, or acrylamide alkyl quaternary ammonium salt type or methacrylamide alkyl quaternary ammonium salt type cationic polymers described in Japanese Patent Publication Open to Public Inspection No. 63-115780, copolymers of dimethylallylammonium chloride and acrylamide described in Japanese Patent Publication Open to Public Inspection Nos. 64-9776 and 64-75281, cationic polymers containing at least two quaternary nitrogen atoms in the repeating units described in Japanese Patent Publication Open to Public Inspection No. 3-133686, polyvinylpyrrolidone having a quaternary ammonium salt group described in Japanese Patent Publication Open to Public Inspection No. 4-288283, cationic polymers prepared by allowing secondary amine to react with epihalohydrin described in Japanese Patent Publication Open to Public Inspection Nos. 6-92010 and 6-234268, polystyrene type cationic polymers described in International Patent Publication Open to Public Inspection No. 99-64248, and cationic polymers comprised of repeating units having at least two cationic groups described in Japanese Patent Publication Open to Public Inspection No. 11-348409.

Specific examples of repeating units having a quaternary ammonium salt group are illustrated below.

CM-1

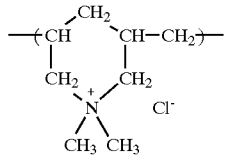

CM-2

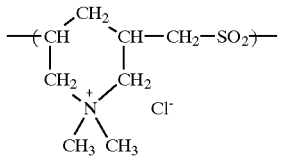

CM-3

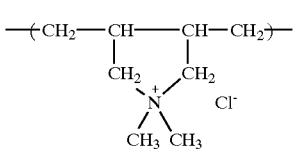

-continued
CM-4
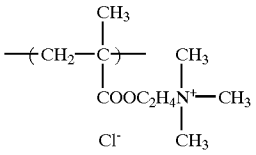
CM-5
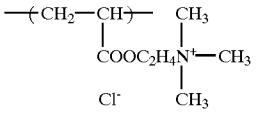
CM-6
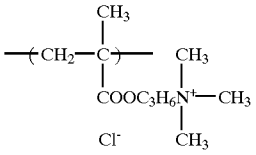
CM-7
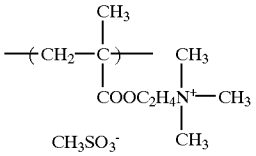
CM-8
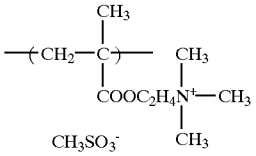
CM-9
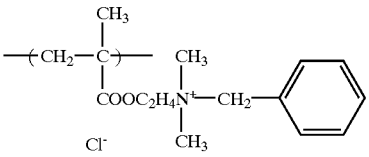
CM-10
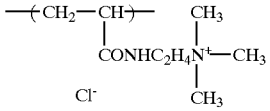
CM-11
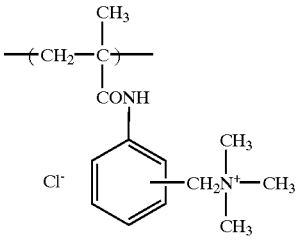
CM-12
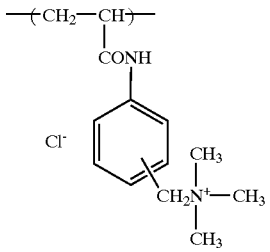
-continued
CM-13
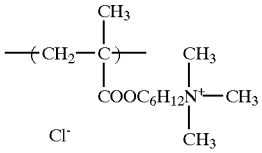
CM-14
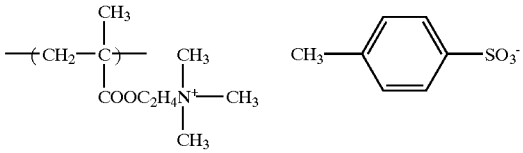
CM-15
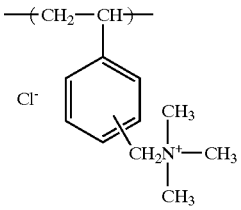
CM-16
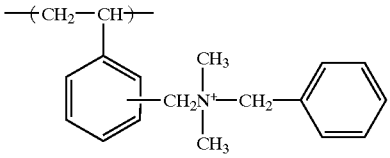
CM-17
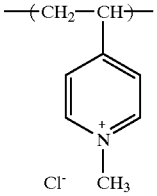
CM-18
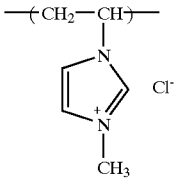
CM-19
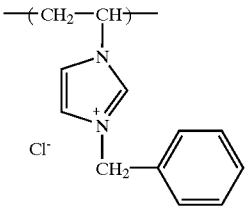
CM-20
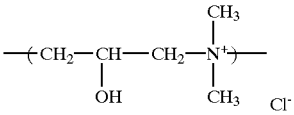
The cationic polymers described in item 1 may be homopolymers of repeating units having a quaternary ammonium salt group or condensation products thereof, or copolymers with other copolymerizable repeating units having neither a quaternary ammonium salt group nor a tertiary amino group.

Said copolymerizable repeating units are those derived from monomers having one or at least two copolymerizable unsaturated bonds. Listed as specific examples of such monomers may be those listed below.

Styrene, vinyl chloride, vinylidene chloride, acrylic acid, methacrylic acid, acrylic acid ester, methacrylic acid ester (methyl acrylate, methyl methacrylate, ethyl acrylate, ethyl methacrylate, propyl acrylate, propyl methacrylate, butyl acrylate, butyl methacrylate, octyl acrylate, octyl methacrylate, hydroxyethyl acrylate, hydroxyethyl methacrylate, hydroxypropyl acrylate, and hydroxypropyl methacrylate), acrylamide, methacrylamide, butadiene, ethylene, vinyl acetate, vinyl methyl ether, acrylonitrile, N-vinyl-2-pyrrolidone, maleic acid, and divinylbenzene.

When cationic polymers having a quaternary ammonium salt group are said copolymers, the content ratio of repeating units having said quaternary ammonium group is generally at least 10 mol percent of said cationic polymers, and is most preferably at least 20 mol percent.

Listed as specific examples of cationic polymers capable of being employed in item 1 of the present invention may be polymers described in Table 1 below.

In Table 1, CM represents the repeating units having a quaternary ammonium salt group, and Q1, Q2, and Q3 each represent the repeating units of said quaternary ammonium salt group. Other symbols are represented by the following abbreviated symbols.

ST: styrene
MMA: methyl methacrylate
EMA: ethyl methacrylate
NPMA: N-propyl methacrylate
NBA: N-butyl methacrylate
HEMA: hydroxoyethyl methacrylate
AA: acrylamide
VP: N-vinyl-2-pyrrolidone Further, the content ratio of copolymers is shown by mol percent in parentheses of Table 1.

TABLE 1

| Polymer | CM | Q1 | Q2 | Q3 | Average Molecular Weight |
|---|---|---|---|---|---|
| CP-1 | CM-1 (100) | — | — | — | 23,000 |
| CP-2 | CM-2 (100) | — | — | — | 16,000 |
| CP-3 | CM-4 (100) | — | — | — | 12,000 |
| CP-4 | CM-15 (100) | — | — | — | 43,000 |
| CP-5 | CM-18 (100) | — | — | — | 20,000 |
| CP-6 | CM-20 (100) | — | — | — | 35,000 |
| CP-7 | CM-1 (60) | AA (40) | — | — | 93,000 |
| CP-8 | CM-3 (80) | AA (20) | — | — | 76,000 |
| CP-9 | CM-4 (50) | MMA (50) | — | — | 62,000 |
| CP-10 | CM-9 (40) | MMA (60) | — | — | 29,000 |
| CP-11 | CM-17 (80) | EMA (20) | — | — | 33,000 |
| CP-12 | CM-4 (50) | MMA (30) | EMA (20) | — | 42,000 |
| CP-13 | CM-4 (45) | MMA (25) | EMA (20) | HEMA (10) | 26,000 |
| CP-14 | CM-4 (45) | MMA (20) | EMA (20) | NPMA (15) | 33,000 |
| CP-15 | CM-15 (60) | NBA (40) | — | — | 66,000 |
| CP-16 | CM-15 (80) | EMA (10) | HEMA (10) | — | 73,000 |
| CP-17 | CM-15 (70) | AA (10) | NPMA (20) | — | 61,000 |
| CP-18 | CM-l8 (80) | VF (20) | — | — | 86,000 |
| CP-19 | CM-18 (80) | MAA (10) | EMA (10) | — | 42,000 |
| CP-20 | CM-18 (50) | MAA (30) | EMM (10) | HEMA (10) | 24,000 |

At least two types of the cationic polymers described in item 1 may be employed in combination of at least three types. The used amount of each of the cationic polymers, which are employed in combinations of two, is preferably at least 20 mol percent by weight with respect to the total cationic polymers. Further, when three types are employed in combination, the used amount of each of said cationic polymers is preferably 10 mol percent with respect to the total cationic polymers.

It is preferable that in the recording sheet described in item 1, at least one type of said cationic polymer is that represented by Formula (1) below and at least one type of said cationic polymer is represented by Formula (2) below.

Formula (1)

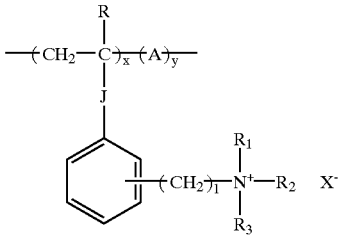

wherein R represents a hydrogen atom or an alkyl group; $R_1$, $R_2$, and $R_3$ each represent an alkyl group or a benzyl group; J represents a bond group or a divalent organic group; $X^-$ represents an anion group; "A" represents the repeating unit having no quaternary ammonium salt group in its molecule; "l" represents positive figure of 1 to 6; "x" represents 5 to 100 (mol ratio); and "y" represents 0 to 95 (mol ratio).

Formula (2)

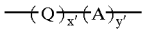

wherein Q represents the repeating unit represented by Formula (2A), (2B), or (2C) below.

"A" is as defined for "A" in Formula (1). "x'" represents 5 to 100 (mol ratio) and "y'" represents 0 to 95 (mol ratio).

Formula (2A)

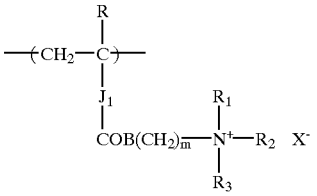

wherein R, $R_1$, $R_2$, and $R_3$, and $X^-$ are as defined above for R, $R_1$, $R_2$, and $R_3$, and $X^-$ of Formula (1);

$J_1$ represents a bond group or a divalent organic group; B represents —O— or —N($R_5$)— (wherein $R_5$ represents a hydrogen atom, an alkyl group, an allyl group, or a benzyl group); and "m" represents a positive figure of 1 to 6.

Formula (2B)

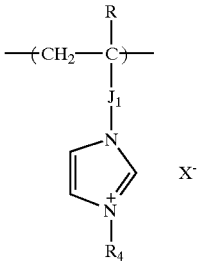

wherein R and $X^-$ are as defined above for R and $X^-$ of Formula (1); $J_1$ is as defined above for $J_1$ of Formula (2A); and $R_4$ represents an alkyl group.

Formula (2C)

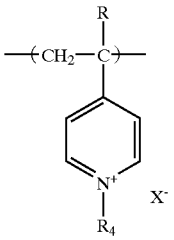

wherein R and $X^-$ are as defined above for R and $X^-$ of Formula (1), and $R_4$ is as defined above for $R_4$ of Formula (2B).

The ink jet recording sheet according to item 3 will now be described.

The ink jet recording sheet according to item 3 comprises cationic polymers having at least two types of repeating units having a quaternary ammonium salt group or a tertiary amino group.

Employed herein as repeating units having a quaternary ammonium salt group may be those employed in the ink jet recording sheet in item 1.

Further, listed as specific examples of repeating unit having a tertiary amino group may be those shown below.

CM-21

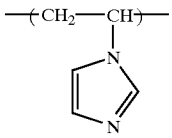

CM-22

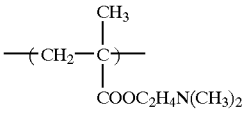

CM-23

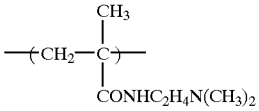

CM-24

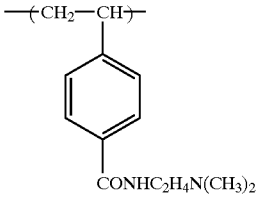

CM-25

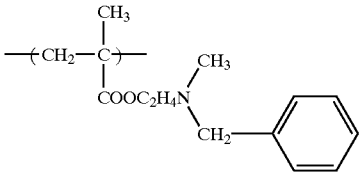

CM-26

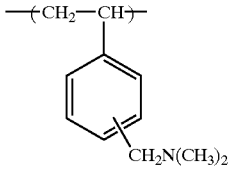

Cationic polymers employed in the ink jet recording sheet according to item 3 may be copolymers of repeating units having neither a quaternary ammonium salt group nor a tertiary amino group. Listed as such repeating units having neither a quaternary ammonium salt group nor a tertiary amino group may be repeating units derived from copolymerizable monomers of the cationic polymers employed in the ink jet recording sheet of item 1.

Table 2 shows specific examples of cationic polymers according to item 3.

TABLE 2

| Polymer | CM (1) | CM (2) | Q1 | Q2 | Average Molecular Weight |
|---|---|---|---|---|---|
| CP-21 | CM-4 (30) | CM-9 (30) | MMA (20) | EMA (20) | 66,000 |
| CP-22 | CM-4 (40) | CM-15 (40) | EMA (20) | — | 86,000 |
| CP-23 | CM-4 (20) | CM-15 (60) | NBA (20) | — | 32,000 |
| CP-24 | CM-4 (40) | CM-18 (40) | EMA (10) | HEMA (10) | 43,000 |
| CP-25 | CM-4 (40) | CM-21 (30) | NBA (20) | ST (10) | 36,000 |
| CP-26 | CM-4 (60) | CM-22 (20) | MMA (10) | EMM (10) | 27,000 |

TABLE 2-continued

| Polymer | CM (1) | CM (2) | Q1 | Q2 | Average Molecular Weight |
|---|---|---|---|---|---|
| CP-27 | CM-4 (50) | CM-22 (20) | VP (30) | — | 31,000 |
| CP-28 | CM-15 (45) | CM-16 (35) | NMA (10) | EMA (10) | 46,000 |
| CP-29 | CM-15 (45) | CM-17 (25) | MMA (15) | HEMA (15) | 39,000 |
| CP-30 | CM-15 (60) | CM-18 (30) | NBA (10) | — | 21,000 |
| CP-31 | CM-15 (50) | CM-18 (20) | VP (30) | — | 14,000 |
| CP-32 | CM-15 (60) | CM-21 (30) | VP (10) | — | 26,000 |
| CP-33 | CM-15 (60) | CM-18 (20) | CM-21 (20) | — | 35,000 |
| CP-34 | CM-15 (60) | CM-22 (30) | NBA (10) | — | 42,000 |
| CP-35 | CM-18 (50) | CM-21 (40) | EMA (10) | — | 55,000 |
| CP-36 | CM-18 (60) | CM-22 (40) | — | — | 62,000 |

The cationic polymers according to item 5 will now be described.

The ink jet recording sheet according to item 5 comprises cationic polymers having a quaternary ammonium salt group, as well as cationic polymers having a tertiary amino group in the same layer.

Listed as examples of cationic polymers having a quaternary ammonium salt group may be those employed in the ink jet recording sheet of item 1.

Listed as examples of cationic polymers having a tertiary amino group may be polymers derived from repeating units having a tertiary amino group in the cationic polymers of the ink jet sheet of item 3.

Said cationic polymers having a tertiary amino group may be homopolymers, condensation products, or copolymers with other copolymerizable monomers.

Table 3 shows specific examples of cationic polymers having a tertiary amino group according to item 5.

TABLE 3

| Polymer | CM | Q1 | Q2 | Average Molecular Weight |
|---|---|---|---|---|
| CP-37 | CM-21 (100) | — | — | 34,000 |
| CP-38 | CM-22 (100) | — | — | 39,000 |
| CP-39 | CM-23 (100) | — | — | 63,000 |
| CP-40 | CM-21 (80) | VP (20) | — | 38,000 |
| CP-41 | CM-21 (30) | CM-22 (40) | HEMA (30) | 61,000 |
| CP-42 | CM-21 (70) | AA (30) | — | 16,000 |
| CP-43 | CM-23 (80) | HEMA (20) | — | 25,000 |
| CP-44 | CM-23 (80) | VP (20) | — | 38,000 |
| CP-45 | CM-26 (50) | VP (50) | — | 47,000 |
| CP-46 | CM-26 (80) | AA (20) | — | 18,000 |

The ratio of said cationic polymers having a quaternary ammonium salt group to cationic polymers having a tertiary amino group is generally from 1:10 to 10:1.

The cationic polymers according to item 7 will now be described.

Said cationic polymers according to item 7 are those having an amido group represented by Formula (A-1) or a hydroxy group represented by Formula (A-2). Said hydroxyl group or amido group may be present in repeating units having a cationic group, or in repeating units having no cationic group. Preferred repeating units having a cationic group are Formulas (1A), (2A), (2B), (2C), (3A), (3B), (3C), and (3D).

The content ratio of repeating units having a hydroxyl group or an amido group is preferably at least 5 mol percent with respect to the total repeating units.

Listed as specific examples of cationic polymers according to item 7 are CP-6, CP-7, CP-8, CP-13, CP-16, CP-17, CP-20, CP-24, CP-41, and CP-43. In addition to these, for example, polymers, shown in Table 4, are also listed.

TABLE 4

| Polymer | CM (1) | CM (2) | Q1 | Q2 | Average Molecular Weight |
|---|---|---|---|---|---|
| CP-47 | CM-4 (50) | CM-27 (50) | — | — | 75,000 |
| CP-48 | CM-4 (50) | CM-27 (30) | HEMA (20) | — | 33,000 |
| CP-49 | CM-21 (25) | CM-27 (30) | MAA (30) | EMA (25) | 18,000 |
| CP-50 | CM-15 (35) | CM-4 (50) | HEMA (15) | — | 47,000 |
| CP-51 | CM-15 (45) | CM-21 (30) | CM-27 (25) | — | 36,000 |
| CP-52 | CM-15 (50) | CM-27 (30) | HEMA (20) | — | 23,000 |
| CP-53 | CM-20 (80) | AA (20) | — | — | 86,000 |

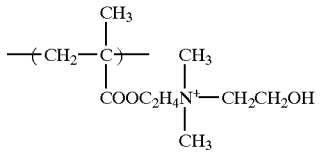

The recording sheet of the present invention includes one in which the porous ink absorptive layer is comprised of at least two layers having differing constitutions. In this case, in order to minimize bleeding, it is preferable that all porous layers comprise cationic polymers having a quaternary ammonium salt group incorporated into said porous ink absorptive layer.

When said porous ink absorptive layer is comprised of at least two layers, cationic polymers incorporated into each ink absorptive layer are selected so that the combination with ink is optimized. Generally, cationic polymers, which exhibit greater dyeing affinity with dyes, is preferably employed in the ink absorptive layer farther from the support so as to result in high density as well as minimized color variation during storage.

In the recording sheet according to items 1 through 9, the used amount of cationic polymers having a quaternary ammonium salt group is commonly in the range of 0.3 to 10 g per $m^2$ of said recording sheet, and is preferably from 0.5 to 5.

The average molecular weight of cationic polymers according to the present invention is preferably in the range of 2,000 to 500,000, and is more preferably in the range of 10,000 to 200,000.

The average molecular weight, as described herein, refers to the number average molecular weight, and also refers to ethylene glycol converted values obtained employing gel permeation chromatography.

Further, when the cationic polymers according to the present invention are previously added to a coating composition, said polymers may be uniformly added to said coating composition or may be added so as to form composite particles together with fine inorganic particles. Listed as methods for forming composite particles employing fine inorganic particles and cationic polymers are a method in which fine inorganic particles are mixed with cationic polymers so that said fine inorganic particles are adsorbed with and covered by said cationic polymers, a method in which the resulting covered particles are coagulated so as to obtain higher degree composite particles, or a method in which coarse particles obtained by mixing are converted into uniform composite particles employing a homogenizer.

The cationic polymers according to the present invention are generally water soluble due to possession of a water-solubilizing group. However, due to compositions of copolymerizing components, some may be insoluble in water. In order to make the production easier, they are preferably water-soluble. However, when they are barely soluble in water, it is possible to dissolve and employ them utilizing water-miscible organic solvents.

Said water-miscible organic solvents, as described herein, refer to organic solvents including alcohols such as methanol, ethanol, isopropanol, and n-propanol; glycols such as ethylene glycol, diethylene glycol, and glycerin; esters such as ethyl acetate and propyl acetate; ketones such as acetone and methyl ethyl ketone; and amides such as N,N-dimethylformamide, which are soluble in water generally in a amount of at least 10 percent. In this case, it is preferable that the used amount of organic solvents is less than that of water.

Supports employed in the recording sheet of the present invention will now be described.

Employed as supports of the ink jet recording sheet of the present invention may be a water absorptive or a non-water absorptive support.

As said water absorptive support, paper supports are generally employed. In addition, cloth and porous film supports are usable.

Listed as non-water absorptive supports are plastic resinous film supports and supports prepared by covering both sides of paper with a resinous film.

Listed as plastic resinous film supports are polyester film, polyvinyl chloride film, polypropylene film, cellulose triacetate film, and polystyrene film, or film supports obtained by laminating any of these. Of these plastic resinous films, either transparent or translucent supports may be employed.

In the present invention, non-water absorptive supports are preferred, which result in no wrinkling during printing. Particularly preferred supports are those prepared by covering both sides of the paper base with plastic resins, and the most preferred supports are those prepared by covering both sides of the paper base with polyolefin resins.

The supports prepared by covering both sides of said paper with polyolefin resins will now be described, which are preferably employed in the present invention.

Paper employed in the supports of the present invention is made employing wood pulp as the main raw material and in addition, if desired, synthetic pulp such as polypropylene and synthetic fiber such as nylon and polyester. Employed as said wood pulp may be any of LBKP, LBSP, NBKP, NBSP, LDP, NDP, LUKP, and NUKP. However, it is preferable that LBKP, NBSP, LBSP, NDP, and LDP comprising short fiber component in a relatively large amount are preferably employed in a larger amount. Incidentally, the ratio of LBSP and/or LDP is preferably from 10 to 70 percent.

Preferably employed as said pulp is chemical pulp (sulfate pulp and sulfite pulp) comprising minimal impurities. Further, also useful is pulp which has been subjected to a bleaching treatment to increase its whiteness.

Suitably incorporated into said paper may be sizing agents such as higher fatty acids and alkylketene dimer; white pigments such as calcium carbonate, talc, and titanium oxide; paper strength enhancing agents such as starch, polyacrylamide, and polyvinyl alcohol; optical brightening agents; moisture retention agents such as polyethylene glycols; dispersing agents; and softeners such as quaternary ammonium.

The degree of water freeness of pulp employed for paper making is preferably between 200 and 500 ml according to CSF Specification. Further, the sum of the weight percent of 24-mesh residue and the weight percent of 42-mesh calculated portion regarding the fiber length after beating, specified in JIS P 8207, is preferably between 30 and 70 percent. Further, the weight percent of 4-mesh residue is preferably 20 percent by weight or less.

The weight of said paper is preferably from 50 to 250 $g/m^2$, and is most preferably from 70 to 200 g. The thickness of said paper is preferably from 50 to 210 $\mu$m.

During the paper making stage, or alternatively after paper making, said paper may be subjected to a calendering treatment resulting in excellent smoothness. The density of said paper is generally from 0.7 to 1.2 $g/m^2$ (JIS P 8118) Further, the stiffness of said paper is preferably from 20 to 200 g under the conditions specified in JIS P 8143.

Surface sizing agents may be applied onto the paper surface. Employed as said surface sizing agents may be the same as those above, capable of being incorporated into said base paper.

The pH of said paper, when determined employing a hot water extraction method specified in JIS P 8113, is preferably from 5 to 9.

Polyolefin resins, which cover both sides of said paper, will now be described.

Preferably employed as polyolefin resins to achieve said purposes are polyethylene, polypropylene, polyisobutylene, and polyethylene. Of these, polyolefins such as copolymers comprised of propylene as the main component are preferred, and polyethylene is particularly preferred.

The particularly preferred polyethylene will now be described.

Polyethylene, which covers both surfaces of paper, is mainly comprised of low density polyethylene (LDPE) and/or high density polyethylene (HDPE), but it is also possible to partially employ LLDPE and polypropylene.

Specifically, rutile or anatase type titanium dioxide is preferably incorporated into the polyolefin layer on the coating layer side so as to improve opacity as well as whiteness. The content ratio of said titanium oxide is commonly from 1 to 20 percent with respect to the polyolefin, and is preferably from 2 to 15 percent.

High heat resistant color pigments and optical brightening agents for adjusting white background may be incorporated into said polyolefin layer.

Listed as said color pigments are ultramarine, Prussian blue, cobalt blue, phthalocyanine blue, manganese blue, cerulean, tungsten blue, molybdenum blue, and anthraquinone blue.

Listed as said optical brightening agents are dialkylaminocoumarin, bisdimethylaminostilbene, bismethylaminostilbene, 4-alkoxy-1,8-naphthalenenedicaroxylic acid-N-alkyklimide, bisbenzoxazolylethylene, and dialkylstilbene.

The amount of polyethylene used on both surfaces of paper is selected so as to optimize curling at low and high humidity after providing an ink absorptive layer as well as a backing layer. The thickness of the polyethylene layer on the ink absorptive layer side is generally in the range of 15 to 50 μm, while said thickness on the backing layer side is generally from 10 to 40 μm. It is preferable that the ratio of polyethylene on the front surface to that on the opposite surface is determined to optimize curling which varies depending on the type and thickness of the ink receptive layer and the thickness of the core paper. Said polyethylene ratio of the front surface/opposite surface is generally from about 3/1 to about 1/3 in terms of the thickness.

Further, it is preferable that said polyethylene coated support exhibits characteristics (1) through (7), described below.

(1) Tensile strength is preferably from 2 to 30 kg in the longitudinal direction and from 1 to 20 kg in the lateral direction, in terms of the strength specified in JIS P 8113.
(2) Tear strength is preferably from 20 to 300 g in the longitudinal direction and from 10 to 250 g in the lateral direction, in terms of the strength specified in JIS P 8116.
(3) Compressive elasticity modulus is preferably at least 9.8 $kN/cm^2$.
(4) Opacity is preferably at least 80 percent and is most preferably from 85 to 98 percent, when determined employing the method specified in JIS P 8138.
(5) Preferable whiteness of L*, a*, and b*, specified in JIS Z 8727, are to be in the following range: L* from 80 to 96; a* from −3 to +5; and b* from −7 to +2.
(6) Clark stiffness of the support is preferably from 50 to 300 $cm^2/100$ in the recording sheet conveying direction.
(7) Moisture of said paper is to be from 4 to 10 percent with respect to the core paper.
(8) Glossiness (75-degree specular glossiness) of the support, on which the ink receptive layer is provided, is preferably 10 to 90 percent.

The ink jet recording sheet of the present invention employs polyvinyl alcohol as the binder of the ink absorptive layer. Said binders are partially cross-linked with the compounds of the present invention, which comprise a zirconium atom or an aluminum atom. It is preferable that said ink absorptive layer is further cross-linked with boric acid and/or salts thereof.

Boric acid and/or salts thereof, employed in the present invention, refer to oxygen acid having a boron atom as the central atom and/or salts thereof, and specifically include orthoboric acid, diboric acid, metaboric acid, tetraboric acid, pentaboric acid, and octaboric acid, and salts thereof.

The amount of boric acid and/or salts thereof used varies and depends on the types of polyvinyl alcohol, the types of cross-linking agents, the types of fine inorganic particles, and the ratio with respect to polyvinyl alcohol. However said used amount is commonly from 5 to 500 mg per g of said polyvinyl alcohol, and is preferably from 10 to 300 mg.

Boric acid and/or salts thereof, when an ink absorptive layer forming water-soluble coating composition employed in the present invention is coated, may be incorporated into said coating composition. Alternatively, after said ink absorptive layer forming water-soluble coating composition (including no hardeners) is coated and subsequently dried, boric acid and/or salts thereof may be provided in such a manner that its or their solution is subjected to overcoating.

The ink jet recording sheet of the present invention may comprise hardeners other than compounds comprising boric acid and/or salts thereof, as well as a zirconium element.

Generally, hardeners are compounds having a group capable of reacting with polyvinyl alcohol or compounds which accelerate the reaction between different groups incorporating polyvinyl alcohol. Listed as such hardeners are epoxy based hardeners (diglycidyl ethyl ether, ethylene glycol diglycidyl ether, 1,4-butanediol diglycidyl ether, 1,6-diglycidylcyclohexane, N,N-glycidyl-4-glycidyloxyaniline, sorbitol polyglycidyl ether, and glycerol polyglycidyl ether), aldehyde based hardeners (formaldehyde and glyoxal), active halogen based hardeners (2,4-dichloro-4-hydroxy-1,3,5-s-trizine), and active vinyl based compounds (1,3,5-trisacryloyl-hexahydro-s-triazine, bisvinylsulfonyl methyl ether), aluminum alum, and isocyanate compounds.

The amount of hardeners used varies, depending on the types of polyvinyl alcohol, the types of hardeners, the types of fine inorganic particles and the ratio with respect to polyvinyl alcohol. However, said amount is generally from 5 to 500 mg per g of the polyvinyl alcohol, and is preferably from 10 to 300 mg.

In addition to said additives, various other additives may be incorporated into the ink absorptive layer as well as other layers provided, as required of the ink recording sheet of the present invention.

The following various types of additives, known in the art, may also be incorporated: for example, polystyrene, polyacrylic acid esters, polymethacrylic acid esters, polyacrylamides, polyethylene, polypropylene, polyvinyl chloride, polyvinylidene chloride, or copolymers thereof; minute organic latex particles of urea resins or melamine resins; various types of cationic or nonionic surface active agents; UV absorbers described in Japanese Patent Publication Open to Public Inspection Nos. 57-74193, 57-87988, and 62-261476; anti-fading additives described in Japanese Patent Publication Open to Public Inspection Nos. 57-74192, 57-87989, 60-72785, 61-146591, 1-95091, and 3-13376; optical brightening agents described in Japanese Patent Publication Open to Public Inspection Nos. 59-42993, 59-52689, 62-280069, 61-242871, and 4-219266; pH regulators such as sulfuric acid, phosphoric acid, citric acid, sodium hydroxide, potassium hydroxide, and potassium carbonate; antifoaming agents, antiseptics, thickeners, antistatic agents, and matting agents.

It is possible to apply various types of ink absorptive layers and sublayers of the ink jet recording paper of the present invention, which are provided as required, onto a support, employing a method suitably selected from those known in the art. The preferred methods are such that the coating composition constituting each layer is applied onto a support and subsequently dried. In this case, it is possible to simultaneously apply at least two layers onto said support, and simultaneous coating is particularly preferred in which all hydrophilic binder layers are simultaneously coated.

Employed as coating methods are a roll coating method, a rod bar coating method, an air knife coating method, a spray coating method, and a curtain coating method. In addition, preferably employed is the extrusion coating method employing a hopper, described in U.S. Pat. No. 2,681,294.

The pH of the recording layer surface of the ink jet recording sheet of the present invention is preferably from 3.5 to 7.5. When the pH of the layer surface is less than 3.5, ink jet recording tends to result in so-called bronzing in which dyes are subjected to deposition which results in metallic gloss. On the other hand, when said pH exceeds 7.5, bleeding minimizing effects are degraded.

The pH of said recording layer surface in accordance with the present invention was determined after an elapse of 30 seconds while employing water, following the method described in TAPPI Paper and Pulp Test Method No. 49.

In the present invention, it is possible to adjust the pH of said recording layer surface to the specified range by adjusting the pH of the recording layer forming coating composition. Further, after forming the recording layer, the pH may be adjusted to the specified range by overcoating suitable pH modulators. Employed as pH modulators may be suitable acid or alkali solutions. In this case, the types of acid and alkali as well as their concentration may be suitably selected depending on the pH adjustment range.

When images are recorded employing the ink jet recording sheet of the present invention, a recording method, employing a water-based ink, is preferably utilized.

The water-based ink, as described herein, refers to a recording liquid comprised of colorants and liquid media described below, as well as other additives. Employed as said colorants are direct dyes, acidic dyes, basic dyes, reactive dyes, water-soluble food dyes, or water-dispersible pigments, which are known in the art of ink jet printing.

Listed as solvents in said water-based ink are water and various water-soluble organic solvents, including for example, alcohols such as methyl alcohol, isopropyl alcohol, and butyl alcohol, tert-butyl alcohol, and isobutyl alcohol; amides such as dimethylformamide and dimethylacetamide; ketones or ketone alcohols such as acetone and diacetone alcohol; ethers such as tetrahydrofuran and dioxane; polyalkylene glycols such as polyethylene glycol and polypropylene glycol; polyhydric alcohols such as ethylene glycol, propylene glycol, butylene glycol, triethylene glycol, 1,2,6-hexanetriol, thioglycol, hexylene glycol, diethylene glycol, glycerin, and triethanolamine; and lower alkyl ethers of polyhydric alcohols such as ethylene glycol methyl ether, diethylene glycol methyl (or ethyl) ether, and triethylene glycol monobutyl ether.

Of these, preferred are polyhydric alcohols such as diethylene glycol, triethanolamine, and glycerin, and lower alkyl esters of polyhydric alcohols such as triethylene glycol monobutyl ether.

Listed as other water-based ink additives are, for example, pH regulators, metal sequestering agents, fungicides, viscosity modifiers, surface tension controlling agents, wetting agents, surface active agents, and antirusting agents.

In order to improve the wettability of said water-based ink to said recording sheet, said water-based ink generally exhibits a surface tension in the range of 0.025 to 0.060 N/m at 20° C., and preferably in the range of 0.030 to 0.050 N/m.

EXAMPLES

The present invention will now be specifically described with reference to examples. However, the embodiments of the present invention are not to be construed as being limited to these examples. Incidentally, "percent" in the examples is percent by weight unless otherwise specified.

Example 1

<<Preparation of Ink Jet Recording Sheets 1 Through 6>>

Added to 100 g of 15 percent aqueous solution (at a pH of 3.2) of each of the cationic polymers shown in Table 5 were 500 g of a 25 percent aqueous dispersion of fine silica particles (QS-20, manufactured by Tokuyama) having an average primary particle diameter of about 12 nm, and subsequently 3.0 g of boric acid as well as 0.7 g of borax. The resulting mixture was dispersed employing a high speed homogenizer. Subsequently, added to the resulting aqueous dispersion were 5 ml of a 10 percent aqueous solution of polyvinyl alcohol (PVA 203, manufactured by Kuraray) and 290 ml of a 6 percent aqueous solution of polyvinyl alcohol (PVA 245, also manufactured by Kuraray). Finally, the total volume of said dispersion was adjusted to 1,000 ml by adding pure water, whereby a translucent coating composition was prepared.

Subsequently, the coating composition, prepared as above, was applied onto the recording side surface of a paper support (having a thickness of 260 μm and comprising anatase type titanium dioxide in an amount of 6 percent by weight in the polyethylene layer on the recording side) to obtain a wet layer thickness of 180 μm. After chilling the coating at 8° C. for 10 seconds, the chilled coating was dried employing a 30° C. air flow for 60 seconds, a 50° C. air flow for 60 seconds, and a 70° C. air flow for 60 seconds. Thereafter, the dried coating was subjected to adjustment of moisture content at 25° C. and 50 percent relative humidity, whereby Ink Jet Recording Sheets 1 through 6, having a layer surface pH of 5.1, were prepared.

TABLE 5

| Recording Sheet | Cationic Polymer (1) | Cationic Polymer (2) |
|---|---|---|
| 1 | CP-5 (100) | — |
| 2 | CP-12 (100) | — |
| 3 | CP-15 (100) | — |
| 4 | CP-12 (50) | CP-15 (50) |
| 5 | CP-12 (50) | CP-5 (50) |
| 6 | CP-15 (50) | CP-5 (50) |

Each figure in ( ) of Cationic Polymer shows a weight ratio.

<<Preparation of Ink Jet Recording Sheets 1A Through 6A, 1B through 6B, 1C through 6C, and 1D through 6D>>

An aqueous solution of water-soluble polyvalent metal ions as additives, shown in Table 6, was overcoated onto each coating surface of said Ink Jet Recording Sheets 1 through 6 to obtain a solid coated amount of 0.6 g/m$^2$, and subsequently dried. Thereafter, the pH of the layer surface was adjusted to 4.5±0.2 by uniformly spraying either an aqueous nitric acid solution or an aqueous sodium hydroxide solution onto the coating surface, whereby Ink Jet Recording Sheets 1A through 6A, 1B through 6B, 1C through 6C, and 1D through 6D were prepared.

TABLE 6

| Overcoat Composition | Additive | Recording Sheet |
|---|---|---|
| A | magnesium sulfate | 1A–6A |
| B | calcium chloride | 1B–6B |
| C | polychlorinated aluminum | 1C–6C |
| D | zirconyl acetate | 1D–6D |

polychlorinated aluminum: Paho#2S, manufactured by Asada Kagaku Co., Ltd.
zirconyl acetate: Zircozol ZA, manufactured by Daiichi Kigenso Kagaku Co., Ltd.

Each bleeding, bronzing and ink absorption rate of the obtained ink jet recording sheets was determined employing the methods described below.

(1) Bleeding

About 0.3 mm wide black lines were printed on the background of a solid magenta print employing an ink jet printer PM770C, manufactured by Seiko-Epson Co., and stored at 50° C. and 85 percent relative humidity for 3 days. The line width (the width of the area having a 50 percent reflection density of the maximum density was designated as the line width) before and after said storage was determined employing a microdensitometer. Then the value obtained by the following formula was designated as bleeding. The smaller said value, the less bleeding there was.

Image bleeding=(line width after image storage/line width before image storage)

(2) Bronzing

A black solid image was printed employing the printer used in (1), and after storing the resulting image at 23° C. and 80 percent relative humidity for one week, the resulting printed image state was visually inspected and the degree of bronzing generation was evaluated as described below.

A: no bronzing was noticed

B: bronzing was partly noticed

C: marked bronzing was noticed.

(3) Ink Absorbability

A liquid transition amount (in ml/m$^2$) was obtained during a contact time of 0.04 second, employing Bristow Tester Type II (being a pressurized type), manufactured by Kumagai Riki Kogyo Co., Ltd.

Table 7 shows the obtained results.

TABLE 7

| Recording Sheet | | Bleeding | Bronzing | Ink Absorb-ability |
|---|---|---|---|---|
| 1 | Comparative Example | 2.75 | A | 7.4 |
| 1A | Comparative Example | 2.09 | C | 7.6 |
| 1B | Comparative Example | 2.14 | C | 7.3 |
| 1C | Comparative Example | 1.86 | C | 9.6 |
| 1D | Comparative Example | 1.70 | B | 11.5 |
| 2 | Comparative Example | 3.11 | A | 8.6 |
| 2A | Comparative Example | 2.26 | C | 9.2 |
| 2B | Comparative Example | 2.35 | C | 9.0 |
| 2C | Comparative Example | 2.01 | C | 10.5 |
| 2D | Comparative Example | 2.14 | C | 12.1 |
| 3 | Comparative Example | 2.21 | A | 6.5 |
| 3A | Comparative Example | 1.96 | C | 6.2 |
| 3B | Comparative Example | 1.99 | C | 7.0 |
| 3C | Comparative Example | 1.76 | C | 8.9 |
| 3D | Comparative Example | 1.82 | C | 9.3 |
| 4 | Comparative Example | 2.54 | A | 7.7 |
| 4A | Comparative Example | 1.84 | C | 7.9 |
| 4B | Comparative Example | 1.76 | C | 8.1 |
| 4C | Present Invention | 1.42 | A | 10.6 |
| 4D | Present Invention | 1.32 | A | 11.5 |
| 5 | Comparative Example | 2.77 | A | 7.7 |
| 5A | Comparative Example | 1.56 | C | 8.1 |
| 5B | Comparative Example | 1.43 | C | 8.3 |
| 5C | Present Invention | 1.31 | A | 10.4 |
| 5D | Present Invention | 1.25 | A | 10.9 |
| 6 | Comparative Example | 2.42 | A | 8.6 |
| 6A | Comparative Example | 1.27 | C | 8.8 |
| 6B | Comparative Example | 1.34 | C | 9.1 |
| 6C | Present Invention | 1.22 | A | 10.6 |
| 6D | Present Invention | 1.16 | A | 11.7 |

Based on the results shown in Table 7, it is noticed that when the cationic polymers are individually employed (Recording Sheets 1 through 3), bleeding is reduced for the use of any of Overcoat Compositions A through D, while bronzing occurs during storage at high humidity.

By contrast, it is noticed that when two types of cationic polymers are employed and Overcoat Composition C (polychlorinated aluminum) and Overcoat Composition D (zirconyl acetate) are employed, bleeding is minimized without bronzing. It is also noticed that even when two types of polymers are employed in combination, Overcoat Composition A (magnesium sulfate) and Overcoat Composition B (calcium chloride) result in minimized bleeding but do result in bronzing.

Example 2

Recording Sheets 10 through 13 were prepared in the same manner as Recording Sheet 1 of Example 1, except that the cationic polymer was replaced with those shown in Table 8.

TABLE 8

| Recording Sheet | Cationic Polymer |
|---|---|
| 10 | CP-22 |
| 11 | CP-26 |
| 12 | CP-28 |
| 13 | CP-32 |

Ink Jet Recording Sheets 10A through 13A, 10B through 13B, 10C through 13C, and 10D through 13D were prepared in the same manner as Recording Sheets 1A, 1B, 1C, and 1D of Example 1, except that each of the aqueous solutions of water-soluble polyvalent ions shown in Table 6 as the additive, were overcoated.

The resulting sheets were evaluated in the same manner as Example 1. Table 9 shows the obtained results.

TABLE 9

| Recording Sheet | | Bleeding | Bronzing | Ink Absorb-ability |
|---|---|---|---|---|
| 10 | Comparative Example | 2.46 | A | 8.2 |
| 10A | Comparative Example | 1.62 | C | 9.6 |
| 10B | Comparative Example | 1.50 | C | 9.2 |
| 10C | Present Invention | 1.36 | A | 10.0 |
| 10D | Present Invention | 1.42 | A | 11.4 |
| 11 | Comparative Example | 2.76 | A | 7.5 |
| 11A | Comparative Example | 2.06 | C | 7.7 |
| 11B | Comparative Example | 1.95 | C | 8.0 |
| 11C | Present Invention | 1.49 | A | 10.4 |
| 11D | Present Invention | 1.55 | A | 11.1 |
| 12 | Comparative Example | 2.31 | A | 8.0 |
| 12A | Comparative Example | 1.60 | C | 8.3 |
| 12B | Comparative Example | 1.72 | C | 8.6 |
| 12C | Present Invention | 1.42 | A | 10.1 |
| 12D | Present Invention | 1.36 | A | 11.5 |
| 13 | Comparative Example | 2.96 | A | 7.4 |
| 13A | Comparative Example | 2.01 | C | 7.6 |
| 13B | Comparative Example | 1.92 | C | 8.0 |
| 13C | Present Invention | 1.74 | A | 10.9 |
| 13D | Present Invention | 1.46 | A | 12.7 |

Based on the results shown in Table 9, it is noticed that only when the cationic polymers comprising at least two types of repeating units, having a quaternary ammonium salt group or a tertiary amino group of the present invention, are employed and Overcoat Compositions C and D are employed, it is possible to minimize bronzing as well as bleeding.

Example 3

Recording Sheets 20 through 23 were prepared in the same manner as Recording Sheet 1 of Example 1, except that the cationic polymer was replaced with ones shown in Table 10.

TABLE 10

| Recording Sheet | Cationic Polymer (1) | Cationic Polymer (2) |
|---|---|---|
| 20 | CP-3 (50) | CP-37 (50) |
| 21 | CP-3 (50) | CP-38 (50) |
| 22 | CP-4 (50) | CP-37 (50) |
| 23 | CP-4 (50) | CP-38 (50) |

Further, Ink Jet Recording Sheets 20A through 23A, 20B through 23B, 20C through 23C, and 20D through 23D were prepared in the same manner as Recording Sheets 1A, 1B, 1C, and 1D of Example 1, except that each of the aqueous solution of water-soluble polyvalent ions, shown in Table 6 as the additive, were overcoated.

The resulting sheets were evaluated in the same manner as Example 1. Table 11 shows the obtained results.

TABLE 11

| Recording Sheet | | Bleeding | Bronzing | Ink Absorb-ability |
|---|---|---|---|---|
| 20 | Comparative Example | 3.65 | A | 7.0 |
| 20A | Comparative Example | 2.01 | C | 7.2 |
| 20B | Comparative Example | 1.84 | C | 7.8 |
| 20C | Present Invention | 1.72 | A | 9.6 |
| 20D | Present Invention | 1.77 | A | 11.0 |
| 21 | Comparative Example | 3.40 | A | 8.4 |
| 21A | Comparative Example | 2.11 | C | 8.7 |
| 21B | Comparative Example | 2.06 | C | 8.7 |
| 21C | Present Invention | 1.97 | A | 10.3 |
| 21D | Present Invention | 1.85 | A | 11.6 |
| 22 | Comparative Example | 3.80 | A | 8.0 |
| 22A | Comparative Example | 2.15 | C | 8.5 |
| 22B | Comparative Example | 2.02 | C | 8.8 |
| 22C | Present Invention | 1.84 | A | 10.3 |
| 22D | Present Invention | 1.73 | A | 12.1 |
| 23 | Comparative Example | 3.52 | A | 7.5 |
| 23A | Comparative Example | 2.03 | C | 7.9 |
| 23B | Comparative Example | 1.97 | C | 8.6 |
| 23C | Present Invention | 1.72 | A | 10.6 |
| 23D | Present Invention | 1.65 | A | 11.7 |

Based on the results shown in Table 11, it is noticed that only when the cationic polymer having a quaternary ammonium salt group and cationic polymer having a tertiary amino group of the present invention are employed in combination, and Overcoat Compositions C and D are also employed, it is possible to minimize bronzing as well as bleeding.

Example 4

Recording Sheets 30 through 33 were prepared in the same manner as Recording Sheet 1 of Example 1, except that the cationic polymer was replaced with ones shown in Table 12.

TABLE 12

| Recording Sheet | Cationic Polymer |
|---|---|
| 30 | CP-6 |
| 31 | CP-16 |
| 32 | CP-17 |
| 33 | CP-48 |

Further, Ink Jet Recording Sheets 30A through 33A, 30B through 33B, 30C through 33C, and 30D through 33D were prepared in the same manner as Recording Sheets 1A, 1B, 1C, and 1D of Example 1, except that each of the aqueous solutions of water-soluble polyvalent ions, shown in Table 6 as the additive, were overcoated.

The resulting sheets were evaluated in the same manner as Example 1. Table 13 shows the obtained results.

TABLE 13

| Recording Sheet | | Bleeding | Bronzing | Ink Absorb-ability |
|---|---|---|---|---|
| 30 | Comparative Example | 2.31 | A | 7.6 |
| 30A | Comparative Example | 1.84 | C | 8.8 |

TABLE 13-continued

| Recording Sheet | | Bleeding | Bronzing | Ink Absorb-ability |
|---|---|---|---|---|
| 303 | Comparative Example | 1.72 | C | 9.4 |
| 30C | Present Invention | 1.51 | A | 10.7 |
| 30D | Present Invention | 1.44 | A | 13.4 |
| 31 | Comparative Example | 2.47 | A | 70 |
| 31A | Comparative Example | 1.89 | C | 7.9 |
| 31B | Comparative Example | 1.66 | C | 8.4 |
| 31C | Present Invention | 1.43 | A | 10.2 |
| 31D | Present Invention | 1.27 | A | 12.3 |
| 32 | Comparative Example | 2.38 | A | 7.0 |
| 32A | Comparative Example | 1.72 | C | 8.0 |
| 32B | Comparative Example | 1.65 | C | 8.2 |
| 32C | Present Invention | 1.51 | A | 9.8 |
| 32D | Present Invention | 1.42 | A | 11.1 |
| 33 | Comparative Example | 2.69 | A | 7.5 |
| 33A | Comparative Example | 1.60 | C | 7.9 |
| 333 | Comparative Example | 1.49 | C | 8.2 |
| 33C | Present Invention | 1.45 | A | 10.4 |
| 33D | Present Invention | 1.31 | A | 12.1 |

Based on the results shown in Table 13, it is noticed that only when the cationic polymers having a hydroxyl group or an amido group of the present invention are employed, and Overcoat Compositions C and D are also employed, it is possible to minimize bronzing as well as bleeding.

Example 5

Coating compositions, which were employed to prepare the recording sheets of Examples 1 through 4, were combined as shown in Table 14. Each of said combined coating compositions were applied onto the support, employed in Example 1, to obtain a wet layer thickness shown in Table 14, whereby double-layered Recording Sheets 40 through 45 were prepared.

TABLE 14

| Recording Sheet | Lower Layer Coating Composition | Upper Layer Coating Composition |
|---|---|---|
| 41 | Coating Composition of Recording Sheet 1 (100) | Coating Composition of Recording Sheet 3 (80) |
| 42 | Coating Composition of Recording Sheet 2 (100) | Coating Composition of Recording Sheet 3 (80) |
| 43 | Coating Composition of Recording Sheet 2 (100) | Coating Composition of Recording Sheet 10 (80) |
| 44 | Coating Composition of Recording Sheet 2 (100) | Coating Ccmposition of Recording Sheet 22 (80) |
| 45 | Coating Composition of Recording Sheet 2 (100) | Coating Composition of Recording Sheet 16 (80) |

The figure in ( ) is the wet layer thickness (in $\mu$m)

Subsequently, Recording Sheets 40A through 45A, 40B through 45B, 40C through 45C, and 40D through 45D were prepared in the same manner as Example 1, except that each of the aqueous solutions of water-soluble polyvalent ions, shown in Table 6 as the additive, were overcoated.

The resulting sheets were evaluated in the same manner as Example 1. Table 15 shows the obtained results.

TABLE 15

| Recording Sheet | | Bleeding | Bronzing | Ink Absorb-ability |
|---|---|---|---|---|
| 40 | Comparative Example | 1.83 | A | 6.2 |
| 40A | Comparative Example | 1.52 | C | 6.9 |
| 40B | Comparative Example | 1.45 | C | 7.1 |

TABLE 15-continued

| Recording Sheet | | Bleeding | Bronzing | Ink Absorb-ability |
|---|---|---|---|---|
| 40C | Present Invention | 1.31 | A | 8.8 |
| 40D | Present Invention | 1.22 | A | 10.8 |
| 41 | Comparative Example | 1.98 | A | 8.0 |
| 41A | Comparative Example | 1.41 | C | 8.5 |
| 41B | Comparative Example | 1.32 | C | 8.8 |
| 41C | Present Invention | 1.26 | A | 10.1 |
| 41D | Present Invention | 1.21 | A | 11.4 |
| 42 | Comparative Example | 2.05 | A | 6.9 |
| 42A | Comparative Example | 1.52 | C | 7.2 |
| 42B | Comparative Example | 1.47 | C | 7.4 |
| 42C | Present Invention | 1.40 | A | 8.7 |
| 42D | Present Invention | 1.36 | A | 10.1 |
| 43 | Comparative Example | 2.24 | A | 7.4 |
| 43A | Comparative Example | 1.51 | C | 8.2 |
| 43B | Comparative Example | 1.40 | C | 8.0 |
| 43C | Present Invention | 1.31 | A | 10.2 |
| 43D | Present Invention | 1.36 | A | 10.8 |
| 44 | Comparative Example | 2.20 | A | 7.3 |
| 44A | Comparative Example | 1.40 | C | 7.7 |
| 44B | Comparative Example | 1.30 | C | 8.0 |
| 44C | Present Invention | 1.22 | A | 9.8 |
| 44D | Present Invention | 1.26 | A | 10.3 |
| 45 | Comparative Example | 2.03 | A | 7.1 |
| 45A | Comparative Example | 1.33 | C | 7.3 |
| 45B | Comparative Example | 1.25 | C | 8.0 |
| 45C | Present Invention | 1.23 | A | 10.0 |
| 45D | Present Invention | 1.23 | A | 10.2 |

Table 15 shows that even in a multilayer structure, it is possible to minimize bleeding without bronzing by employing the cationic polymers according to the present invention as well as compounds having a zirconium atom or an aluminum atom in their molecule.

Effects of the Invention

The present invention makes it possible to provide an ink jet recording sheet in which, after printing, water-soluble dyes result in minimized bleeding during storage as well as improvement in water resistance without increasing bronzing, and the ink absorption rate is improved without increasing bronzing.

What is claimed is:

1. An ink jet recording sheet comprising a support having thereon a porous ink absorptive layer comprising:

(i) inorganic particles;

(ii) polyvinyl alcohol;

(iii) at least two cationic polymers having a quaternary ammonium salt group in the molecule; and (iv) polyaluminum chloride or a zirconium atom-containing compound other than zirconium oxide.

2. The ink jet recording sheet of claim 1, wherein said cationic polymers are represented by Formula (1) or by Formula (2), Formula (1):

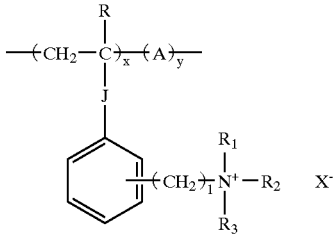

wherein R represents a hydrogen atom or an alkyl group; $R_1$, $R_2$, and $R_3$ each represent an alkyl group or a benzyl group; J represents a bond or a divalent organic group; $X^-$ represents an anion group; A represents a repeating unit having no quaternary ammonium salt group; 1 represents an integer of 1 to 6; x represents 5 to 100 mol %; and y represents 0 to 95 mol %, Formula (2):

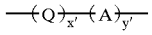

wherein Q represents a repeating unit represented by Formula (2A), (2B), or (2C); A represents a repeating unit having no quaternary ammonium salt group, x' represents 5 to 100 mol % and y' represents 0 to 95 mol %, Formula (2A):

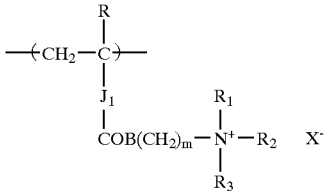

wherein R, $R_1$, $R_2$, and $R_3$, and $X^-$ are the same as defined for R, $R_1$, $R_2$, and $R_3$, and $X^-$ of Formula (1); $J_1$ represents a bond or a divalent organic group; B represents —O— or —N($R_5$)—, wherein $R_5$ represents a hydrogen atom, an alkyl group, an allyl group, or a benzyl group; and m represents an integer of 1 to 6, Formula (2B):

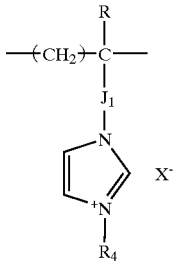

wherein R and $X^-$ are the same as defined for R and $X^-$ of Formula (1); $J_1$ is the same as defined above for $J_1$ of Formula (2A); and $R_4$ represents an alkyl group, Formula (2C):

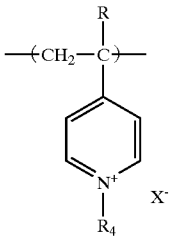

wherein R and $X^-$ are the same as defined for R and $X^-$ of Formula (1), and $R_4$ is the same as defined for $R_4$ of Formula (2B).

3. An ink jet recording sheet comprising a support having thereon a porous ink absorptive layer comprising:

(i) inorganic particles;

(ii) polyvinyl alcohol;

(iii) at least two cationic polymers having a quaternary ammonium salt group in the molecule; and (iv) a compound containing a zirconium atom or an aluminum atom other than zirconium oxide and aluminum oxide, wherein the compound is present in an amount of 0.1 to 5 $g/m^2$ of the ink jet sheet.

* * * * *